United States Patent [19]

Staerzl

[11] Patent Number: 4,492,877

[45] Date of Patent: Jan. 8, 1985

[54] ELECTRODE APPARATUS FOR CATHODIC PROTECTION

[75] Inventor: Richard E. Staerzl, Fond du Lac, Wis.

[73] Assignee: Brunswick Corporation, Skokie, Ill.

[21] Appl. No.: 402,191

[22] Filed: Jul. 26, 1982

[51] Int. Cl.[3] ..... H01B 7/28

[52] U.S. Cl. ..... 307/95; 204/196; 204/147

[58] Field of Search ..... 307/91, 95; 440/113, 440/900, 49; 204/195 C, 196, 147, 419, 435

[56] References Cited

U.S. PATENT DOCUMENTS

| | | | |
|---|---|---|---|
| 3,953,742 | 4/1976 | Anderson et al. | 307/95 |
| 4,322,633 | 3/1982 | Staerzl | 307/95 |
| 4,351,703 | 9/1982 | Winslow | 204/147 X |

*Primary Examiner*—A. D. Pellinen
*Assistant Examiner*—Todd E. DeBoer
*Attorney, Agent, or Firm*—O. T. Sessions

[57] ABSTRACT

An electrode apparatus (15) is provided for mounting an anode (17) and reference electrode (19) of a cathodic protection system on an outboard drive unit (10). The apparatus includes an insulating housing (20) on which the anode (17) and reference electrode (19) are mounted and a copper shield (30) mounted between the anode (17) and electrode (19) to allow them to be mounted in close proximity to each other. The shield (30) is electrically connected to the device to be protected and serves to match the electrical field potential at the reference electrode (19) to that of a point on the outboard drive unit (10) remote from the housing (20).

11 Claims, 3 Drawing Figures

ELECTRODE APPARATUS FOR CATHODIC PROTECTION

DESCRIPTION

TECHNICAL FIELD

This invention relates to cathodic protection systems and particularly to electrode mounting arrangements for such systems.

BACKGROUND ART

Cathodic protection systems for marine devices are well known and various configurations of anodes and reference electrodes have been tried. For example, U.S. Pat. No. 3,853,730 to Anderson teaches separate anode and reference electrode configurations for mounting on the hull of a boat to provide cathodic protection for an outboard motor or stern drive propulsion unit attached to the boat. These anodes and electrodes are suitable for use in a cathodic protection system such as that disclosed U.S. Pat. No. 4,322,633 to the present inventor. As with all known systems, the reference electrode must be mounted a substantial distance from the anode to provide an appropriate reference signal indicative of the potential of the protected unit, thus generally necessitating mounting the electrodes on the boat remote from the propulsion unit.

DISCLOSURE OF INVENTION

The present invention is particularly directed to a cathodic protection apparatus for a submersible metal unit subject to corrosion. The cathodic protection apparatus includes a submersible anode, a submersible reference electrode, and a current supply means connected between the anode and the protected metal unit and further connected to the reference electrode to regulate the potential of the metal unit by maintaining the metal unit at a selected potential relative to the reference electrode. In order to allow the reference electrode to be conveniently mounted adjacent to the anode, a metallic element is mounted in close proximity to the reference electrode. The metallic element is connected to the metal unit to be protected to cause the distance between the reference electrode and anode to electrically simulate the distance between the anode and a selected portion of the metal unit.

The metallic element may be formed essentially of copper, both to reduce the formation of marine growth and to assure that the element will be higher on the galvanic series than the metals protected by the system.

The metallic element may be placed between the reference electrode and the anode to increase its effect.

The invention may take the form of an electrode mounting apparatus for a marine cathodic protection device. The electrode mounting apparatus includes a housing formed of an electrically insulating material suitable for mounting on a submersible body, a submersible anode and reference electrode mounted on the housing remote from each other, and a metallic shield mounted on the housing adjacent to the reference electrode. Both the reference electrode and the anode include connection means for connecting them to the current supply means. The metallic shield includes a connection means for connecting the shield to the submersible metal unit to be protected from corrosion. The shield acts to match the electrical field potential at the reference electrode to that of a point on the submersible metal unit remote from the housing. Thus arranged, the electrode mounting apparatus is conveniently packaged as a single unit which may readily be mounted in an appropriate position to provide cathodic protection to the sumbersible metal unit.

In the foregoing arrangement, the shield may be positioned between the anode and the reference electrode. The reference electrode may further be located between the shield and the housing to enhance the electrical effect of the shield as well as to provide physical protection for the electrode.

Conveniently, the electrode mounting apparatus may be mounted directly on the submersible metal unit to be protected. It can be attached by a fastener, e.g. a bolt, extending through the shield and the housing, with the fastener thus providing the connection means between the shield and the metal unit.

BEST MODE FOR CARRYING OUT THE INVENTION

Figure 1:
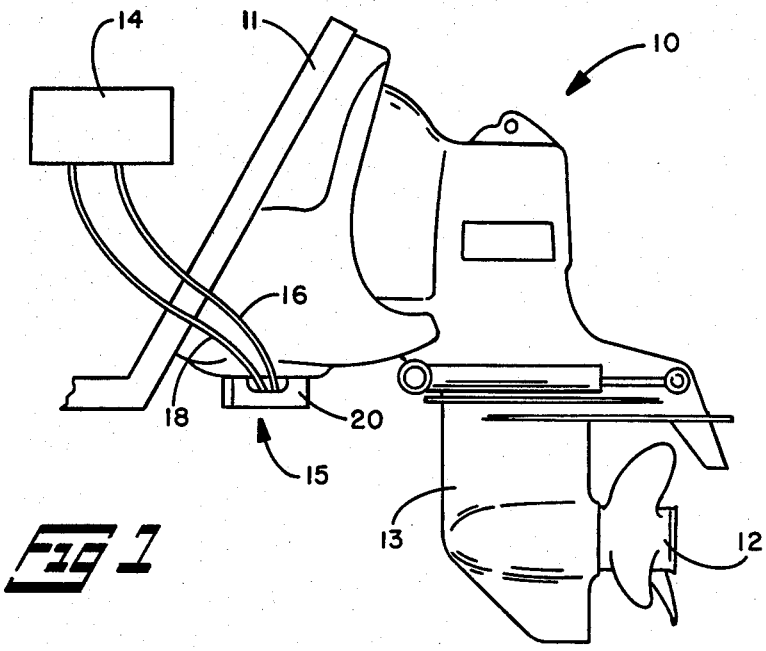
FIG. 1 is a view showing the electrode apparatus of the invention mounted on a marine stern drive unit.
Figure 2:
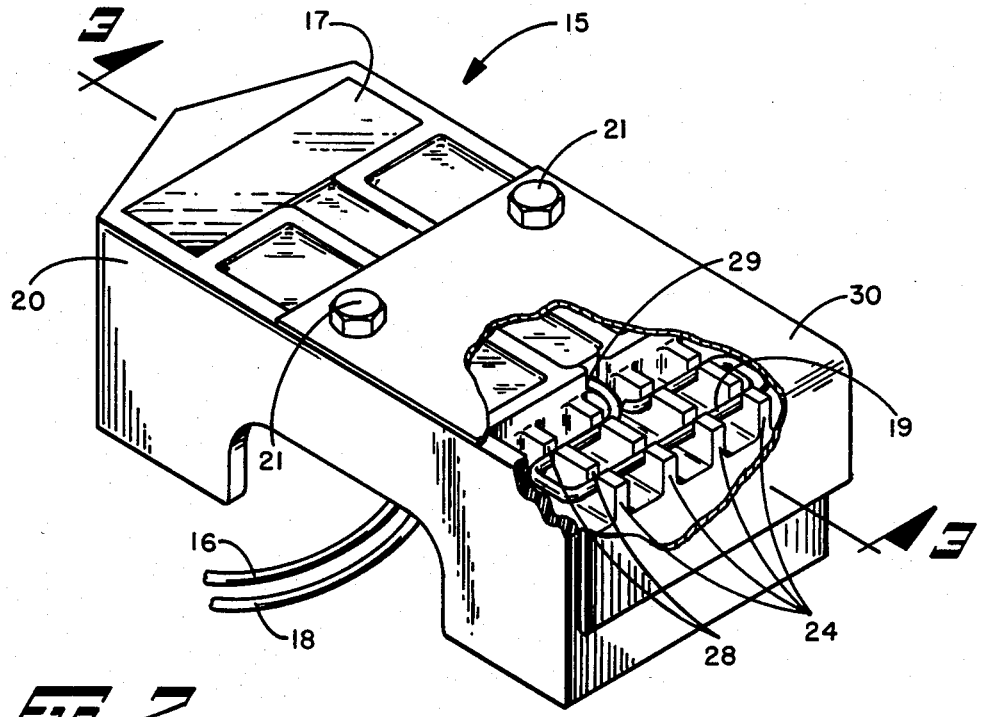
FIG. 2 is a top view of the electrode apparatus shown in FIG. 1.
Figure 3:
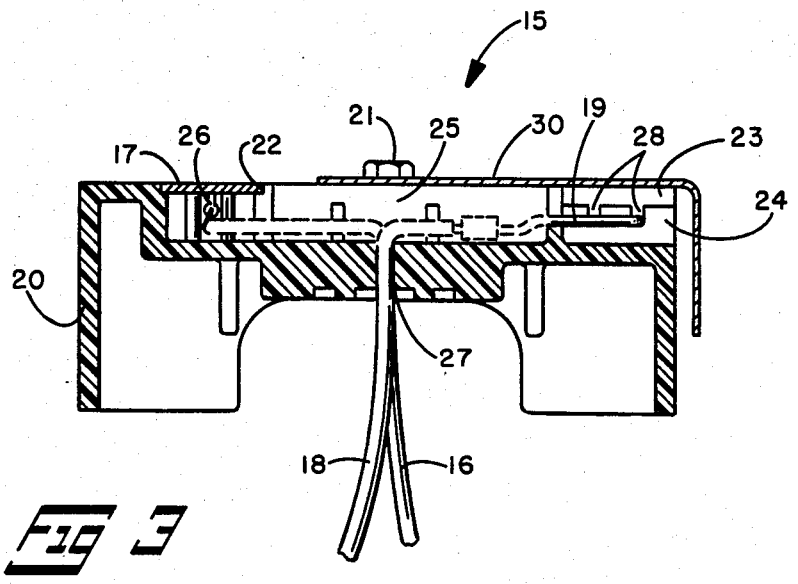
FIG. 3 is a sectional view in elevation taken along line 3—3 of FIG. 2.

Referring to the drawings and particularly to FIG. 1, the lower unit 10 of a marine stern drive is shown mounted on a boat transom 11. The lower unit 10 includes a propeller 12 which is coupled to an internal combustion engine mounted inside the boat for propelling a boat over a body of water. The lower unit 10 includes an outer housing 13, generally formed of aluminum, and houses a drive shaft and gearing which may be formed of other metals. The aluminum lower unit 10 is subject to corrosion, particularly when used in salt water.

A cathodic protection system is provided to protect the lower unit from corrosion by maintaining the lower unit at a selected electrical potential such as 0.94 volts. The cathodic protection system includes a battery powered controller 14 and an electrode apparatus 15 connected to the controller 14 and mounted on the lower unit 10 of the stern drive. The controller 14 may be of any suitable type such as the one disclosed in U.S. Pat. No. 4,322,633 to the present inventor and will have a first lead 16 for connecting to an anode 17 and a second lead 18 for connecting to a reference electrode 19.

Both the anode 17 and the reference electrode 19 are mounted on a housing 20 which in turn is mounted on the lower unit 10 of a stern drive in a location that will be submerged when the boat is at rest. In the preferred embodiment, the electrode housing 20 also serves as a cover for the hydraulic trim manifold and is attached to the lower unit 10 housing by a pair of bolts 21. The electrode housing 20 is formed of an electrically insulating material such as glass filled nylon. The housing 20 includes a rectangular recess 22 at one end on its lower surface to house the anode 17 and a cavity 23 at its other end to house the reference electrode 19. The reference electrode cavity 23 includes several ribs 24 for supporting the reference electrode 19 and is open on the bottom and end. A splice cavity 25 is provided between the anode recess 22 and the reference electrode cavity 23 to provide space for routing cables connected to the reference electrode 19 and anode 17.

The anode 17 consists of a rectangular plate formed of titanium with platinum plating on its lower conducting surface to provide a surface inert to the effects of the marine environment and includes an eyelet 26 on its interior side. An electrical lead 16 is soldered to the eyelet 26 and routed under the anode 17, through the splice cavity 25 and out the cable exit hole 27. The anode 17 is then embedded in epoxy in the anode recess 22 to retain it in the recess, leaving only the platinum plated surface exposed to the marine environment.

The reference electrode 19 consists of a silver wire supported in notches 28 in the ribs 24 in the reference electrode cavity 23. The ribs 24 are heat-swaged over the electrode 19 to retain the wire in place. The silver wire extends through a hole 29 into the splice cavity 25 and is soldered to an electrical lead 18 which extends out the exit hole 27 and is connected to the controller 14. The splice cavity 25 is also filled with epoxy to protect the electrical leads 16 and 18 from the environment.

A metallic shield 30 is mounted on the housing 20 between the anode 17 and the reference electrode 19. Preferably, the shield is formed of a material high enough on the galvanic series to have a potential sufficiently higher than the voltage impressed by the cathodic protection system to avoid polarization of the shield 30 by the protection system. In the preferred embodiment, the shield 30 is formed of electrode-grade copper which provides the additional benefit of reducing the formation of marine growth on the shield 30. The shield 30 has an L-shaped cross-section with the leg portion extending over and spaced from the open end of the reference electrode cavity 23. The shield 30 is attached to the electrode housing 20 and the outer housing of the stern drive by the two mounting bolts 21 which extend through the electrode housing 20 and threadedly engage the stern drive housing 13. The bolts 21 thus serve to retain the shield 30 and electrode housing 20 in place and to provide a direct electrical connection between the shield 30 and the stern drive 10.

In operation, the controller 14 is regulated by the reference electrode 19 to supply current to the anode 17 sufficient to maintain the reference electrode 19 at the selected voltage level. Because the shield 30 serves to shunt current away from the electrode 19, the anode 17 will supply enough current to maintain the selected voltage level at points on the surface of the stern drive remote from the anode 17. Thus, the selected voltage level will be maintained on portions of the stern drive several feet from the anode 17 while the reference electrode 19, positioned several inches from the anode 17 and a fraction of an inch from the shield 30, is maintained at the same level. If a shield 30 was not used, such a placement of the reference electrode 19 would not be practical, since operation in sea water having a resistivity of about 30 ohms per centimeter would result in a substantially different level of protection for the drive unit than would operation in fresh water having a resistivity of up to about 5000 ohms per centimeter. With a properly designed shield 30 placed within a fraction of an inch of the reference electrode 19, however, the operation of the cathodic protection system will be the same in fresh water as in sea water.

The invention thus provides a cathodic protection system which allows the reference electrode to be mounted in close proximity to the anode while maintaining its effectiveness in either salts or fresh water. Both the anode and the reference electrode may be mounted on a single housing which, in turn, may be factory mounted on a stern drive, thus avoiding the possibility of improper mounting of the electrode and anode on a boat by a user.

I claim:

1. In a cathodic protection apparatus for a submersible metal unit subject to corrosion and including a submersible anode, a submersible reference electrode, and a current supply means connected between said anode and said metal unit and to said reference electrode to regulate the potential of said metal unit by maintaining the potential of said metal unit at a selected level relative to said reference electrode, the improvement comprising:

A metallic shield element mounted in close proximity to said reference electrode and said anode and connected to said metal unit to cause a first distance between said electrode and said anode to electrically simulate a second distance between said anode and a selected portion of said submersible metal unit, said second distance greater than said first distance, whereby said reference electrode can be mounted adjacent to said anode.

2. The apparatus defined in claim 1 wherein said metallic element is essentially copper.

3. The apparatus defined in claim 2 wherein said metallic element is mounted between said reference electrode and said anode.

4. An electrode mounting apparatus for a marine cathodic protection device, comprising:

(A) a housing formed of an electrically insulating material for mounting on a submersible body;

(B) a submersible anode mounted on said housing and including a connection means for connecting said anode to a current supply means;

(C) a submersible reference electrode mounted on said housing remote from said anode and including a connection means for connecting said electrode to said current supply means to provide a reference signal to said current means; and (D) a metallic shield mounted on said housing adjacent to said reference electrode and including a connection means for connecting said shield to a submersible metal unit subject to corrosion, said shield acting to match the electrical field potential at said reference electrode to that of a point on said submersible metal unit remote from said housing.

5. The apparatus defined in claim 4 wherein said metallic shield is positioned between said anode and said reference electrode.

6. The apparatus defined in claim 5 wherein said reference electrode is positioned between said metallic shield and said housing.

7. The apparatus defined in claim 6 wherein said housing includes a recessed portion and said reference electrode is mounted in said recess.

8. The apparatus defined in claim 7 wherein said shield partially covers said recess.

9. The apparatus defined in claim 8 wherein said housing is mounted on said submersible body by a fastener extending through said shield and said housing.

10. The apparatus defined in claim 9 wherein said fastener provides said connection means for connecting said shield to said submersible metal unit.

11. The apparatus defined in claim 10 wherein said housing is mounted directly on said submersible metal unit.

* * * * *